US012060871B2

(12) United States Patent
Zhu

(10) Patent No.: US 12,060,871 B2
(45) Date of Patent: Aug. 13, 2024

(54) WATER PUMP AND PUMPING DEVICE

(71) Applicant: BEIJING XIAOMI MOBILE SOFTWARE CO., LTD., Beijing (CN)

(72) Inventor: Kenan Zhu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 318 days.

(21) Appl. No.: 17/587,651

(22) Filed: Jan. 28, 2022

(65) Prior Publication Data

US 2023/0131498 A1 Apr. 27, 2023

(30) Foreign Application Priority Data

Oct. 25, 2021 (CN) ..... 202111243232.6

(51) Int. Cl.
*F04B 35/00* (2006.01)
*F04B 43/02* (2006.01)

(52) U.S. Cl.
CPC ..... *F04B 35/00* (2013.01); *F04B 43/02* (2013.01)

(58) Field of Classification Search
CPC ..... F04B 43/02; F04B 35/00
See application file for complete search history.

(56) References Cited

U.S. PATENT DOCUMENTS

| | | | | |
|---|---|---|---|---|
| 4,053,952 | A * | 10/1977 | Goldstein | A61F 2/0018 128/DIG. 25 |
| 6,050,787 | A * | 4/2000 | Hesketh | F04B 43/09 92/170.1 |
| 2007/0164427 | A1* | 7/2007 | Sauciuc | H01L 23/427 257/714 |
| 2019/0293523 | A1* | 9/2019 | Paprotny | G01N 1/2211 |

FOREIGN PATENT DOCUMENTS

| | | | |
|---|---|---|---|
| CN | 104564624 | A | 4/2015 |
| CN | 111156160 | A | 5/2020 |
| CN | 112879273 | A | 6/2021 |
| CN | 113007076 | A | 6/2021 |
| DE | 3102032 | A1 | 8/1982 |
| JP | 1978060704 | A | 5/1978 |
| JP | 1984224478 | A | 11/1985 |
| JP | 1991026336 | U | 3/1991 |
| RU | 2065995 | C1 | 8/1996 |
| TW | 434034 | B | 5/2001 |

OTHER PUBLICATIONS

Extended European Search Report of EP Application No. 22153695.6 dated Jul. 21, 2022, (5p).

* cited by examiner

*Primary Examiner* — Connor J Tremarche
(74) *Attorney, Agent, or Firm* — Arch & Lake LLP

(57) ABSTRACT

A water pump, including: a first housing, including a first cavity and further including a one-way water inlet and a one-way water outlet respectively in fluid communication with the first cavity; a flexible pumping part, having magnetism and elasticity, and being flexibly deformable, covering an outside of the first housing, and a second cavity is between the flexible pumping part and the first housing, a water permeable port configured to enable the first cavity and the second cavity to be in fluid communication is formed on the first housing; and a magnetic driving part, having magnetism, being configured to magnetically cooperate with the flexible pumping part to supply power to the flexible pumping part, the flexible pumping part deforms under the power to enable a fluid to conduct a pumping stroke and a suction stroke.

18 Claims, 2 Drawing Sheets

WATER PUMP AND PUMPING DEVICE

CROSS REFERENCE TO RELATED APPLICATION

The present application is based upon and claims the priority of the Chinese patent application No. 202111243232.6 filed on Oct. 25, 2021, the entire content of which is incorporated herein by reference for all purposes.

TECHNICAL FIELD

The present disclosure relates to the technical field of liquid pumps, in particular to a water pump and a pumping device.

BACKGROUND

In the related art, a water pump generally includes a pump body and a driving motor, the pump body is provided with an impeller, an output shaft of the driving motor and the impeller are connected through a coupler, so that the driving motor can drive the impeller to rotate, and thus pumping a fluid through rotation of the impeller.

However, the water pump with the above structure usually has large operation noise, and cannot be used in a place with a mute requirement.

SUMMARY

The present disclosure provides a water pump and a pumping device.

According to a first aspect of the preset disclosure, a water pump is provided, including: a first housing, including a first cavity, the first housing further includes a one-way water inlet and a one-way water outlet respectively in fluid communication with the first cavity; a flexible pumping part, having magnetism and elasticity, and being flexibly deformable, the flexible pumping part covers an outside of the first housing, and a second cavity is between the flexible pumping part and the first housing, a water permeable port configured to enable the first cavity and the second cavity to be in fluid communication is formed on the first housing; and a magnetic driving part, having magnetism and being configured to magnetically cooperate with the flexible pumping part to supply power to the flexible pumping part, the flexible pumping part deforms under the power to enable a fluid to conduct: a pumping stroke and a suction stroke, the fluid in the second cavity flows out from the one-way water outlet via the first cavity in the pumping stroke, and the fluid flows from the one-way water inlet via the first cavity and enters the second cavity in the suction stroke.

According to a second aspect of the present disclosure, a pumping device is provided, including a plurality of water pumps, one of the plurality of water pumps includes: a first housing, including a first cavity, the first housing further includes a one-way water inlet and a one-way water outlet respectively in fluid communication with the first cavity; a flexible pumping part, having magnetism and elasticity, and being flexibly deformable, the flexible pumping part covers an outside of the first housing, and a second cavity is between the flexible pumping part and the first housing, a water permeable port configured to enable the first cavity and the second cavity to be in fluid communication is formed on the first housing; and a magnetic driving part, having magnetism and being configured to magnetically cooperate with the flexible pumping part to supply power to the flexible pumping part, the flexible pumping part deforms under the power to enable a fluid to conduct: a pumping stroke and a suction stroke, the fluid in the second cavity flows out from the one-way water outlet via the first cavity in the pumping stroke, and the fluid flows from the one-way water inlet via the first cavity and enters the second cavity in the suction stroke. The plurality of water pumps are in series connection or parallel connection, and the pumping stroke and the suction stroke of the fluid in the plurality of water pumps are synchronized.

It is to be understood that the foregoing general description and the following detailed description are exemplary and explanatory only and are not restrictive of the disclosure.

BRIEF DESCRIPTION OF THE DRAWINGS

The accompanying drawings, which are incorporated in and constitute a part of this description, illustrate examples consistent with the present disclosure and together with the description serve to explain the principles of the present disclosure.

DETAILED DESCRIPTION

Embodiments will be described in detail herein, examples of which are illustrated in the accompanying drawings. When the following description refers to the accompanying drawings, the same numbers in different drawings represent the same or similar elements unless otherwise indicated. The implementations described in the following embodiments do not represent all implementations consistent with the present disclosure. On the contrary, they are merely examples of a device and a method consistent with some aspects of the present disclosure as detailed in the appended claims. In the present disclosure, without indicating the contrary, orientation terms such as "inside" and "outside" are used to refer to an inside and outside relative to the contours of corresponding parts themselves. Terms such as "first" and "second" are adopted in the present disclosure aim to distinguish one element from another element and have no sequence or consequence meaning.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

Figure 1:
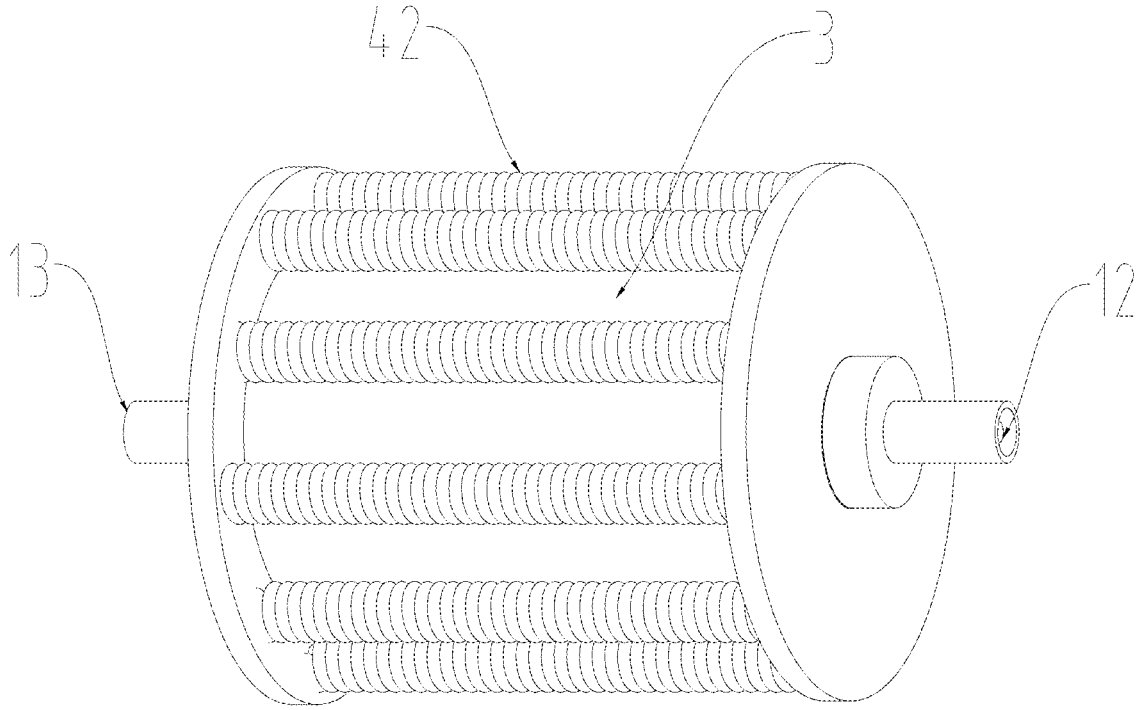
FIG. 1 is a structural schematic diagram of a water pump illustrated according to one or more examples of the present disclosure.
Figure 2:
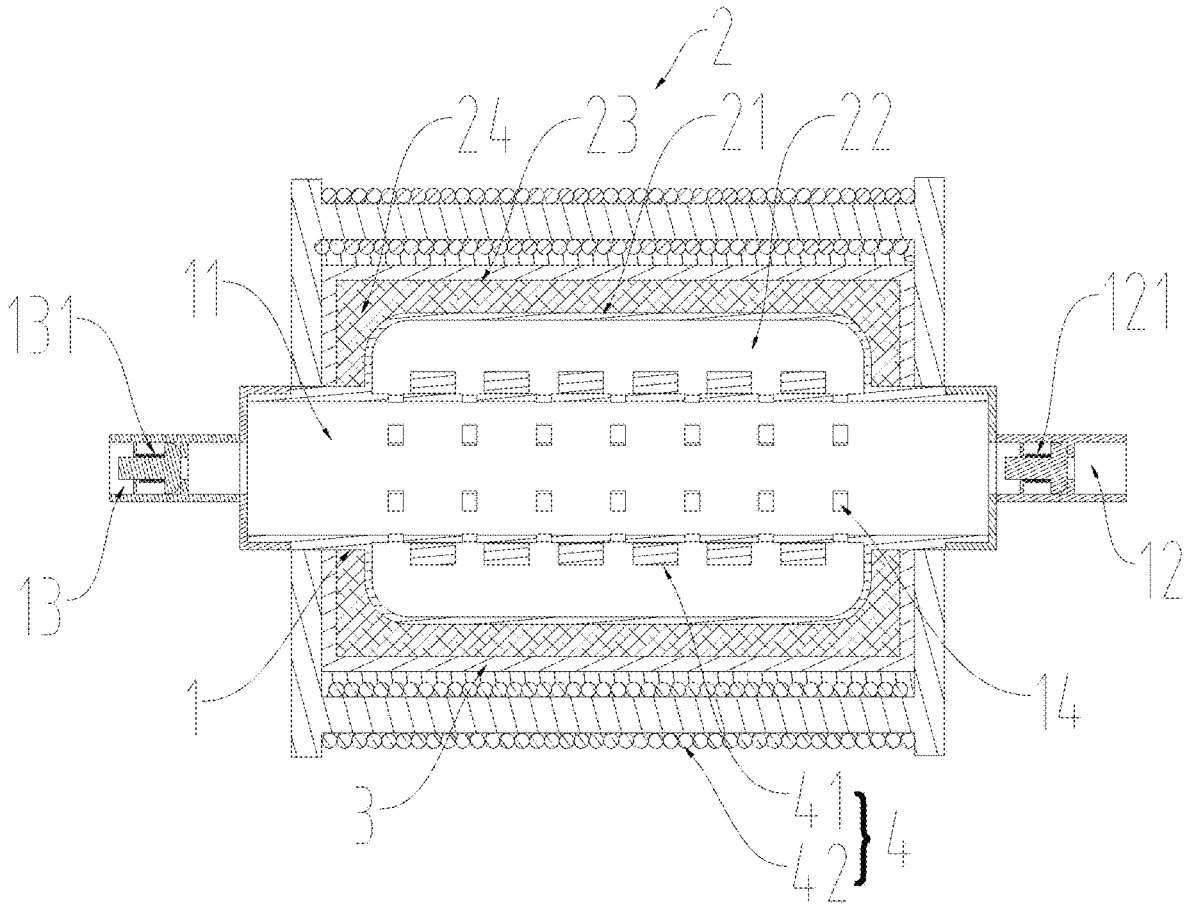
FIG. 2 is a sectional view of a water pump illustrated according to one or more examples of the present disclosure.

According to a first aspect of the present disclosure, a water pump is provided, as shown in FIG. 1 and FIG. 2, the water pump may include a first housing 1, a flexible pumping part 2 and a magnetic driving part 4. The internal of the first housing 1 is formed with a first cavity 11, and the first housing 1 further includes a one-way water inlet 12 and a one-way water outlet 13 respectively in fluid communication with the first cavity 11, so as to suck a fluid through the one-way water inlet 12 and pump out the fluid through the one-way water outlet 13. The flexible pumping part 2 has elasticity and is capable of flexible deformation, and the flexible pump part 2 covers an outside of the first housing 1, and a second cavity 22 is formed between the flexible pumping part 2 and the first housing 1. A water permeable port 14 is formed on the first housing 1, and used to enable the first cavity 11 and the second cavity 22 to be in fluid communication. The fluid sucked through the one-way water inlet 12 may be stored in the second cavity 22 through the water permeable port 14. The flexible pumping part 2 further has magnetism, the magnetic driving part 4 is capable of magnetically cooperating with the flexible pumping part 2 to supply power to the flexible pumping part 2, and the flexible pumping part 2 may deform under an effect of the power to enable the fluid to conduct a pumping stroke, in which the fluid in the second cavity 22 flows out from the one-way water outlet 13 via the first cavity 11, and a suction stroke, in which the fluid flows from the one-way water inlet 12 via the first cavity 11 and enter the second cavity 22. That is, the direction of a magnetic force applied to the flexible pumping part 2 is alternately changed, so as to enable flexible deformation and restoration of the flexible pumping part 2.

Through the above technical solution, in the water pump provided by the present disclosure, the flexible pumping part 2 may flexibly deform towards the first housing 1 under the effect of the power supplied by the magnetic driving part 4 to compress the second cavity 22 so that the fluid in the second cavity 22 may enter the first cavity 11 through the water permeable port 14 and be pumped out through the one-way water outlet 13 for the pumping stroke. Or, the flexible pumping part 2 may restore under an effect of self-elasticity to move away from the first housing 1 to expand the second cavity 22 which is substantially in a vacuum state, so that the fluid may be sucked into the first cavity 11 through the one-way water inlet 12, later, the fluid may enter the second cavity 22 through the water permeable port 14 for the suction stroke. Since the flexible pumping part 2 generates less noise during flexible deformation and restoration, the water pump provided by the present disclosure may have no large noise during operation, and can be used in situations with a need for quietness.

Specifically, the power supplied by the magnetic driving part 4 may include a first power which may enable the flexible pumping part 2 to deform flexibly towards the first housing 1, so that the second cavity 22 deforms from a non-loaded state into a contracted state and causes the fluid to conduct the pumping stroke during deformation, when the first power is eliminated, the flexible deformation of the flexible pumping part 2 is eliminated under an effect of an elastic restoration force and the flexible pumping part 2 moves in a direction away from the first housing 1, so that the second cavity 22 returns to the non-loaded state from the contracted state, and the fluid is enabled to conduct the suction stroke during deformation.

In order to accelerate the suction stroke, the power supplied by the magnetic driving part 4 may further include a second power. The flexible pumping part 2 may be able to accelerate away from the first housing 1 under a dual action of its own elastic restoration force and the second power, so as to accelerate the return of the second cavity 22 from the contracted state to the non-loaded state, and thus accelerating the fluid to be sucked.

As shown in FIG. 1 and FIG. 2, the water pump may further include a second housing 3 covering an outside of the first housing 1. The flexible pumping part 2 may be arranged between the first housing 1 and the second housing 3. The flexible pumping part 2 may include a flexible diaphragm 21 and a magnetic part, and the flexible diaphragm 21 may cover the outside of the first housing 1 and in sealing connection with the first housing 1, the second cavity 22 is formed between the flexible diaphragm 21 and the first housing 1. A third cavity 23 may be formed between the flexible diaphragm 21 and the second housing 3, the magnetic part may be contained in the third cavity 23 and configured to move towards the first housing 1 to compress the second cavity 22 or move away from the first housing 1 to expand the second cavity 22 under driving of the power supplied by the magnetic driving part 4. Since the flexible diaphragm 21 and the first housing 1 are in sealing connection, and the second cavity 22 and the third cavity 23 cannot be in fluid communication, when the magnetic part moves to the first housing 1, which causes the flexible deformation of the flexible diaphragm 21, the fluid in the second cavity 22 may be compressed into the first cavity 11 through the water permeable port 4 and finally flow out through the one-way water outlet 13.

According to a specific implementation of the present disclosure, as shown in FIG. 2, the magnetic part may include a magnetic fluid 24 contained in the third cavity 23. When the magnetic driving part 4 supplies a magnetic force for the magnetic fluid 24 to move towards the first housing 1, the magnetic fluid 24 may generate a uniform pressure on a portion of the flexible diaphragm 21 in contact with the magnetic fluid 24, so as to enable the portion to have uniform flexible deformation towards the first housing 1, thus compressing the second cavity 22 to pump the fluid out of the second cavity 22. When the magnetic driving part 4 supplies a magnetic force for the magnetic fluid 24 to be away from the first housing 1, the magnetic fluid 24 may be attracted to a surface of an inner side of the second housing 3, so that compression to the flexible diaphragm 21 is eliminated, and the portion of the flexible diaphragm 21 that deforms flexibly may restore, and the second cavity 22 expands to suck the fluid into the water pump.

As shown in FIG. 2, the magnetic fluid 24 may be configured as: when the flexible diaphragm 21 is in the non-loaded state, the magnetic fluid 23 fully fills the third cavity 23. It should be noted that the non-loaded state of the flexible diaphragm 21 means a state that the flexible diaphragm 21 has not been compressed and deformed, at the moment, the flexible diaphragm 21 may be in a slightly stretched state and also may be in a totally nature state, that is, when the fluid enters in the pumping stroke from the suction stroke, the magnetic fluid 24 may fully fill the third cavity 23, so that the magnetic fluid 24 can uniformly surround an outer peripheral face of the flexible diaphragm 21, so as to produce an uniform compression force on the entire flexible diaphragm 21 to improve pumping efficiency.

According to another specific implementation of the present disclosure, the magnetic part may further include a plurality of small magnetic balls (not shown) contained in the third cavity 23. When the magnetic driving part 4 supplies a magnetic force for the plurality of small magnetic balls to move towards the first housing 1, the plurality of small magnetic balls may compress the flexible diaphragm 21 so as to enable the flexible diaphragm 21 to flexibly deform toward the first housing 1 to compress the second cavity 22, so that the fluid in the second cavity 22 can be pumped out. When the magnetic driving part 4 supplies a magnetic force for the plurality of small magnetic balls to be away from the first housing 1, the plurality of small magnetic balls can be attracted to a surface of an inner side of a second housing 3, so that compression to the flexible diaphragm 21 is eliminated, and the flexible diaphragm 21 may restore, thus the second cavity 22 expands to suck the fluid into the water pump.

In order to accelerate restoration of the flexible diaphragm 21, according to a specific implementation of the present disclosure, the magnetic part may further include a magnetic coating (not shown) coated on an outer surface of the flexible diaphragm 21. When the magnetic driving part 4 supplies a magnetic force for the flexible pumping part 2 to be away from a first housing 1, the magnetic coating may drive the flexible diaphragm 21 away from the first housing 1, so that restoration of the flexible diaphragm 21 is accelerated to improve sucking efficiency.

According to another specific implementation of the present disclosure, a number of magnets (not shown) may also be fixed on an outer surface of the flexible diaphragm 21, so that restoration of the flexible diaphragm 21 is accelerated to improve sucking efficiency.

Referring to FIG. 1 and FIG. 2, the magnetic driving part 4 may include a first magnet 41 arranged on an outer peripheral face of the first housing 1 and a second magnet 42 arranged on an outer peripheral face of the second housing 3. The first magnet 41 may supply a magnetic force for the magnetic part to move towards the first housing 1, and the second magnet 42 may supply a magnetic force for the magnetic part to move away from the first housing 1. In order to enable the direction of the magnetic force applied to the magnetic part to be alternately changed, at least one of the first magnet 41 and the second magnet 42 is an electromagnet and can be attracted with the magnetic part respectively. In the pumping stroke of the fluid, an attracting force between the first magnet 41 and the magnetic part is larger than an attracting force between the second magnet 42 and the magnetic part, so that a direction of a total magnetic force applied to the magnetic part is towards the first housing 1. In the suction stroke of the fluid, the attracting force between the second magnet 42 and the magnetic part is larger than the attracting force between the first magnet 41 and the magnetic part, so that the direction of the total magnetic force applied to the magnetic part is away from the first housing 1.

According to a specific implementation of the present disclosure, the first magnet 41 and the second magnet 42 may be both electromagnets, the first magnet 41 and the second magnet 42 are alternately energized, that is, when the first magnet 41 is energized, the second magnet 42 is de-energized, so that the magnetic part and the first magnet 41 are mutually attracted, and therefore the fluid is enabled to enter the pumping stroke, and when the second magnet 42 is energized, the first magnet 41 is de-energized, so that the magnetic part and the second magnet 42 are mutually attracted, and therefore the fluid is enabled to enter the suction stroke.

According to another specific implementation of the present disclosure, one of the first magnet 41 and the second magnet 42 is an electromagnet, and the other one is a permanent magnet, that is, the first magnet 41 is the electromagnet, and the second magnet 42 is the permanent magnet, or the first magnet 41 is the permanent magnet, and the second magnet 42 is the electromagnet. The one as the electromagnet is configured to be energized and de-energized at a first preset frequency, and an attracting force to the magnetic part generated during energization is larger than an attracting force to the magnetic part of the one as the permanent magnet, that is, when the one as the electromagnet is energized, the magnetic part may move towards a side on which the electromagnet is provided, and when the one as the electromagnet is de-energized, the magnetic part may move towards a side on which the permanent magnet is provided under an effect of the attracting force of the permanent magnet, so that the fluid may conduct the suction stroke and the pumping stroke alternately.

Referring to FIG. 1 and FIG. 2, the first housing 1, the flexible diaphragm 21 and the second housing 3 may be coaxially arranged, so that the flexible pumping part 2 may be applied with a uniform magnetic force.

In addition, the water pump may further include a third housing (not shown) covering an outer side of the second housing 3, and the third housing may be coaxially arranged with the first housing 1 and the second housing 3.

Referring to FIG. 2, the one-way water inlet 12 is provided with one or more one-way water inlet valves 121 so as to only allow the fluid to flow in, and the one-way water outlet 13 is provided with one or more one-way water outlet valves 131 so as to only allow the fluid to flow out.

According to a second aspect of the present disclosure, a pumping device is provided, and includes a plurality of water pumps in the first aspect. The plurality of water pumps may be in serial connection or parallel connection, and the pumping stroke and the suction stroke of the fluid in the plurality of water pumps are mutually synchronized.

The pumping device provided by the present disclosure has the same beneficial effects with the water pumps in the above technical solutions, in order to avoid unnecessary repetition, it will not be described here. In addition, the plurality of water pumps in serial connection or parallel connection in the pumping device in the present disclosure mutually cooperate so as to improve a water pumping flux and the water pumping efficiency of the pumping device in unit time.

Those skilled in the art will come up with other implementation plans of the present disclosure after considering the specifications and practicing the present disclosure. The present application aims to cover any deformations, purposes or adaptive changes of the present disclosure, which follow general principles of the present disclosure and include undisclosed common general knowledge or conventional technological means in the technical field of the present disclosure. The specifications and examples are considered exemplary only, and the true scope and spirit of the present disclosure are pointed out by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

The invention claimed is:

1. A water pump, comprising:

a first housing, comprising a first cavity, wherein the first housing further comprises a one-way water inlet and a one-way water outlet respectively in fluid communication with the first cavity;

a flexible pumping part, having magnetism and elasticity, and being flexibly deformable, wherein the flexible pumping part covers an outside of the first housing, and a second cavity is between the flexible pumping part and the first housing, wherein a water permeable port configured to enable the first cavity and the second cavity to be in fluid communication is formed on the first housing; and a magnetic driving part, having magnetism and being configured to magnetically cooperate with the flexible pumping part to supply power to the flexible pumping part, wherein the power comprises a first power, the flexible pumping part deforms under the power to enable a fluid to conduct: a pumping stroke and a suction stroke, wherein the fluid in the second cavity flows out from the one-way water outlet via the first cavity in the pumping stroke, the second cavity deforms from a non-loaded state into a contracted state under the first power, and causes the fluid to conduct the pumping stroke during deformation, and wherein the fluid flows from the one-way water inlet via the first cavity and enters the second cavity in the suction stroke, the second cavity returns to the non-loaded state from the contracted state under an elasticity of the flexible pumping part, and causes the fluid to conduct the suction stroke during deformation.

2. The water pump according to claim 1, wherein the power further comprises a second power;

the second cavity returns to the non-loaded state from the contracted state under the elasticity of the flexible pumping part and the second power.

3. The water pump according to claim 1, wherein the water pump further comprises a second housing covering an outside of the first housing, and the flexible pumping part is arranged between the first housing and the second housing; and wherein the flexible pumping part comprises:

a flexible diaphragm, covering the outside of the first housing, and in sealing connection with the first housing, wherein the second cavity is formed between the flexible diaphragm and the first housing, and a third cavity is formed between the flexible diaphragm and the second housing, and a magnetic part, contained in the third cavity, and configured to move towards the first housing to compress the second cavity, or move away from the first housing to expand the second cavity under driving of the power.

4. The water pump according to claim 3, wherein the magnetic part comprises a magnetic fluid contained in the third cavity.

5. The water pump according to claim 4, wherein the magnetic fluid is configured to fully fill the third cavity when the flexible diaphragm is in the non-loaded state.

6. The water pump according to claim 3, wherein the magnetic part comprises a magnetic coating coated on an outer surface of the flexible diaphragm.

7. The water pump according to claim 3, wherein the magnetic part comprises a magnet fixed on an outer surface of the flexible diaphragm.

8. The water pump according to claim 3, wherein the magnetic driving part comprises a first magnet arranged on an outer peripheral face of the first housing and a second magnet arranged on an outer peripheral face of the second housing, and at least one of the first magnet and the second magnet is an electromagnet and is configured to be attracted with the magnetic part respectively;

wherein an attracting force between the first magnet and the magnetic part is larger than an attracting force between the second magnet and the magnetic part in the pumping stroke; and wherein the attracting force between the second magnet and the magnetic part is larger than the attracting force between the first magnet and the magnetic part in the suction stroke.

9. The water pump according to claim 8, wherein the first magnet and the second magnet are both electromagnets, and the first magnet and the second magnet are alternately energized.

10. The water pump according to claim 8, wherein one of the first magnet and the second magnet is an electromagnet, and the other is a permanent magnet, wherein the one as the electromagnet is configured to be energized and de-energized at a first preset frequency, and an attracting force to the magnetic part generated during energization is larger than an attracting force to the magnetic part of the one as the permanent magnet.

11. The water pump according to claim 3, further comprising a third housing covering an outside of the second housing.

12. The water pump according to claim 1, wherein the one-way water inlet is provided with one or more one-way water inlet valves, and the one-way water outlet is provided with one or more one-way water outlet valves.

13. A pumping device, comprising a plurality of water pumps, wherein one of the plurality of water pumps comprises:

a first housing, comprising a first cavity, wherein the first housing further comprises a one-way water inlet and a one-way water outlet respectively in fluid communication with the first cavity;

a flexible pumping part, having magnetism and elasticity, and being flexibly deformable, wherein the flexible pumping part covers an outside of the first housing, and a second cavity is between the flexible pumping part and the first housing, wherein a water permeable port configured to enable the first cavity and the second cavity to be in fluid communication is formed on the first housing; and a magnetic driving part, having magnetism and being configured to magnetically cooperate with the flexible pumping part to supply power to the flexible pumping part, wherein the power comprises a first power, the flexible pumping part deforms under the power to enable a fluid to conduct:

a pumping stroke, wherein a fluid in the second cavity flows out from the one-way water outlet via the first cavity, the second cavity deforms from a non-loaded state into a contracted state under the first power, and causes the fluid to conduct the pumping stroke during deformation, and a suction stroke, wherein the fluid flows from the one-way water inlet via the first cavity and enters the second cavity, the second cavity returns to the non-loaded state from the contracted state under an elastic of the flexible pumping part, and causes the fluid to conduct the suction stroke during deformation, wherein the plurality of water pumps are in series connection or parallel connection, and the pumping stroke and the suction stroke of the fluid in the plurality of water pumps are synchronized.

14. The pumping device according to claim 13, wherein the power further comprises a second power;

the second cavity returns to the non-loaded state from the contracted state under an effect of the elastic of the flexible pumping part and the second power.

15. The pumping device according to claim 13, wherein the water pump further comprises a second housing covering an outside of the first housing, and the flexible pumping part is arranged between the first housing and the second housing; and wherein the flexible pumping part comprises:

a flexible diaphragm, covering the outside of the first housing, and in sealing connection with the first housing, wherein the second cavity is formed between the flexible diaphragm and the first housing, and a third cavity is formed between the flexible diaphragm and the second housing, and a magnetic part, contained in the third cavity, and configured to move towards the first housing to compress the second cavity, or move away from the first housing to expand the second cavity under driving of the power.

16. The pumping device according to claim 15, wherein the magnetic driving part comprises a first magnet arranged on an outer peripheral face of the first housing and a second magnet arranged on an outer peripheral face of the second housing, and at least one of the first magnet and the second magnet is an electromagnet and is configured to be attracted with the magnetic part respectively;

wherein an attracting force between the first magnet and the magnetic part is larger than an attracting force between the second magnet and the magnetic part in the pumping stroke; and wherein the attracting force between the second magnet and the magnetic part is larger than the attracting force between the first magnet and the magnetic part in the suction stroke.

17. The pumping device according to claim 16, wherein the first magnet and the second magnet are both electromagnets, and the first magnet and the second magnet are alternately energized.

18. The pumping device according to claim 16, wherein one of the first magnet and the second magnet is an electromagnet, and the other is a permanent magnet, wherein the one as the electromagnet is configured to be energized and de-energized at a first preset frequency, and an attracting force to the magnetic part generated during energization is larger than an attracting force to the magnetic part of the one as the permanent magnet.

* * * * *